US006357862B1

(12) United States Patent
Ozaki et al.

(10) Patent No.: US 6,357,862 B1
(45) Date of Patent: Mar. 19, 2002

(54) SUBSTRATE FOR INK JET RECORDING HEAD, INK JET RECORDING HEAD AND METHOD OF MANUFACTURE THEREFOR

(75) Inventors: Teruo Ozaki, Yokohama; Masahiko Ogawa, Hino; Yoshiyuki Imanaka, Kawasaki; Muga Mochizuki, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/413,027

(22) Filed: Oct. 6, 1999

(30) Foreign Application Priority Data

Oct. 8, 1998 (JP) ..... 10-301693

(51) Int. Cl.[7] ..... B41J 2/05
(52) U.S. Cl. ..... 347/58
(58) Field of Search ..... 347/58, 62, 19, 347/56, 61, 17; 216/27

(56) References Cited

U.S. PATENT DOCUMENTS

| | | | | |
|---|---|---|---|---|
| 4,723,129 A | | 2/1988 | Endo et al. | 347/56 |
| 4,740,796 A | | 4/1988 | Endo et al. | 347/56 |
| 4,965,594 A | * | 10/1990 | Komuro | 347/62 |
| 5,580,468 A | * | 12/1996 | Fujikawa et al. | 216/27 |
| 5,660,739 A | | 8/1997 | Ozaki et al. | 216/27 |
| 5,896,147 A | | 4/1999 | Mori et al. | 347/61 |
| 5,943,070 A | | 8/1999 | Kamiyama et al. | 347/19 |

FOREIGN PATENT DOCUMENTS

| | | |
|---|---|---|
| JP | 8-112902 | 5/1996 |

* cited by examiner

*Primary Examiner*—N. Le
*Assistant Examiner*—K. Feggins
(74) *Attorney, Agent, or Firm*—Fitzpatrick, Cella, Harper & Scinto

(57) ABSTRACT

The substrate for use of an ink jet recording head is provided with a plurality of heat generating resistive members and the electrode wiring pattern electrically connected with the heat generating resistive members formed on the substrate, and a protection film formed on the heat generating resistive members and the electrode wiring pattern to protect them from ink. For this substrate, each of the heat generating resistive members comprises a first heat generating resistive member arranged on the lower layer of the electrode wiring pattern connected with the heat generating resistive member, and a second heat generating resistive member arranged between the protection film and the electrode wiring pattern. With the structure thus arranged, it becomes possible to make the protection film on the upper layer thinner, and attempt the power saving. Also, it becomes unnecessary to make the effective bubbling area smaller for the provision of a highly reliable ink jet recording head which can operate in high density.

14 Claims, 6 Drawing Sheets

SUBSTRATE FOR INK JET RECORDING HEAD, INK JET RECORDING HEAD AND METHOD OF MANUFACTURE THEREFOR

BACKGROUND OF THE INVENTION

1. Field of the Invention

The present invention relates to the substrate for an ink jet recording head. The invention also relates to an ink jet recording head, and a method of manufacture therefor.

2. Related Background Art

The ink jet recording method disclosed in the specifications of U.S. Pat. No. 4,723,129, U.S. Pat. No. 4,740,796, or the like makes it possible not only to record at high-speed and in high-density, as well as in high image quality, but also, to facilitate forming images in colors with a more compact apparatus. This method has, therefore, attracted more attention of those in the art in recent years particularly.

For the recording head of ink jet recording type, which is arranged to enable ink to bubble by the utilization of thermal energy for discharging ink to a recording medium, it is generally practiced to arrange the structure so that the heat generating resistive members that enable ink to bubble, and the wiring that makes electric connections are incorporated on the same substrate, hence providing an ink jet recording head substrate. Also, the nozzles for discharging ink are formed on the substrate thus provided.

The ink jet recording head substrate is then devised in various ways from the viewpoint of providing a smaller structure and more convenience on one hand, and form the viewpoint of saving the input of the electrical energy on the other hand. There are many devices provided, in particular, for the configuration of the heat generating resistive member connected with the wiring, which forms the heat generating unit, as well as for the arrangement thereof. Then, as the most popular structure, the heat generative resistive material is arranged on the lower layer, and the electrode layer, which is formed by Al material, is arranged on the upper layer in order to form a two-layer structure, and then, the Al on the heat generating portions is removed. In this way, the resistance of each of the heat generating portions becomes higher, and when current flows, thermal energy is generated to enable ink to bubble. Also, on each of the heat generating portions, the protection film is formed to protect the heat generating resistive member and wiring. Thus, the structure of this protection film is one of the important factors, such as the power dissipation and the life thereof, to determine the performance of an ink jet head.

However, with the conventional structure of the protection film, the requirement of the lower power dissipation is eventually incompatible with the enhancement of the film reliability which is need for the maintenance of the longer life of a head.

For example, the lower the power dissipation for ink bubbling, the thinner is the thickness of the film required when provided for the surface that contacts with ink and the heat generating resistive member, and also, the heat transfer ratio thereof should be larger, because, in such arrangement, the escape of heat to the sides other than ink side should be made smaller. In other words, the thinner the protection film, the better the energy efficiency. On the other hand, however, if the protection film is thinner, pin holes may take place on the protection film or it becomes impossible to cover the stepping portions of wringing sufficiently. As a result, ink may enter such portions to erode wiring or to cause the erosion of the heat generating resistive members, thus affecting the reliability of the head, and also, making the life thereof shorter.

In this respect, it is known that the film quality of the protection film is enhanced by making the temperature higher at the time of film formation. However, if the temperature becomes 400° C. or more at the time of forming a protection film, for example, the development of hillocks or the like becomes apparently noticeable in the protection film due to the presence of the Al wiring. Consequently, even if the film quality becomes better on the stepping portions, the Al wiring is subjected to erosion due to the development of the hillocks after all. In order to prevent the erosion of wiring due to the hillocks of the kind, it is necessary to arrange the protection film to be thick enough at least on the wiring portions.

Here, it is possible to evade this question of the hillock development on the Al wiring if the arrangement order of the Al wiring and the heat generating resistive member is inverted. However, with the structure that may be arranged in such order, the film quality of the heat generating resistive member becomes inferior on the stepping portions, because the heat generating resistive member should be in contact with the stepping portions of the Al wiring. As a result, the resistive value of each member becomes greatly varied, and problems are encountered when the members are used actually.

To deal with a problem of the kind, there is disclosed a structure in the specification of Japanese Patent Application Laid-Open No. 08-112902 which makes it possible to lower the power dissipation by making the portions of the protection film thinner on the portions related to bubbling, and at the same time, to enhance the film reliability for the longer life thereof.

In other words, the disclosed structure is formed in the processing steps of preparing a substrate provided with a plurality of heat generating resistive members to give heat to ink, a plurality of wiring connected with each of the heat generating resistive members, and a plurality of heat generating portions formed on the aforesaid heat generating resistive members, which are exposed from the wiring; in the step of covering the heat generating resistive member and wiring on the substrate with a first insulating protection film; of removing the portions of the first insulating protection film on the heat generating portions by means of the wet etching; and in the step of covering the first insulating protection film with a second insulating protection film. In this manner, the etched portions of the first insulating protection film of the heat generating portions in the longitudinal direction are arranged on the inner side by ½ or more of the sum of the thickness of the first and second insulating protection films that cover each area from the end of the heat generating portion to the wiring.

In this respect, each of the heat generating resistive members generates heat all over the surface. However, such heat is allowed to escape from the circumference of each of them greatly. As a result, the temperature becomes lower on circumferential portions, and does not contribute to bubbling eventually. This bubbling condition is observed carefully. As a result, it is ascertained that bubbling is effectuated only on the area which is approximately 4 $\mu$m inside (this area is referred to as the effective bubbling area) in the direction from the circumference of each heat generating resistive member toward the inner side thereof. In accordance with the structure disclosed in the above-mentioned specification of the laid-open application, the thicker portion of the protection film covers even the fundamentally effective bubbling area of each heat generating resistive member. Because of this coverage, the actually effective bubbling area becomes smaller in some cases. The reduction of the effective bubbling area is not regarded as a very serious problem as far as the arrangement pitches of nozzles are not very high. However, if nozzles should be arranged in higher density, the area of the heat generating resistive members becomes smaller with the thickness of the electrodes remaining almost unchanged. Therefore, this problem becomes no longer negligible.

SUMMARY OF THE INVENTION

Now, with a view to solving the problems discussed above, the present invention is designed. It is an object of the invention to provide the substrate for an ink Jet recording head capable of making the life thereof longer in order to enhance the reliability even with the adoption of the thinner film.

Also, it is another object of the invention to provide the substrate for an ink jet recording head having measures as to the effective temperature reduction on the circumference of each of the heat generating resistive members, as well as the maintenance of the longer life thereof to enhance the reliability even with the adoption of the thinner film as described above.

In order to achieve the above-mentioned objectives, the present invention is characteristically structured as given below.

In other word, the ink jet recording head substrate of the present invention is provided with a plurality of heat generating resistive members and the electrode wiring pattern electrically connected with the heat generating resistive members formed on the substrate, and a protection film formed on the heat generating resistive members and the electrode wiring pattern to protect them from ink. For this substrate, each of the heat generating resistive members comprises a first heat generating resistive member arranged on the lower layer of the electrode arrangement pattern connected with the heat generating resistive member, and a second heat generating resistive member arranged between the protection film and the electrode arrangement pattern.

Also, the ink jet recording head of the present invention is provided with an ink jet recording head substrate having a plurality of heat generating resistive members and the electrode wiring (arrangement) pattern electrically connected with the heat generating resistive members formed on the substrate, and a protection film formed on the heat generating resistive members and the electrode wiring pattern to protect them from ink; discharge ports for discharging ink; and liquid paths communicated with the discharge ports. For this ink jet recording head, each of the heat generating resistive members comprises a first heat generating resistive member arranged on the lower layer of the electrode wiring pattern connected with the heat generating resistive member, and a second heat generating resistive member arranged between the protection film and the electrode wiring pattern.

Also, the method of the present invention for manufacturing an ink jet recording head provided with an ink jet recording head substrate having a plurality of heat generating resistive members and the electrode wiring pattern electrically connected with the heat generating resistive members formed on the substrate, and a protection film formed on the heat generating resistive members and the electrode wiring pattern to protect them from ink; the discharge ports for discharging ink; and the liquid paths communicated with the discharge ports, comprising the steps of forming first heat generating resistive members on the substrate; forming the electrode wiring pattern connected with the first heat generating resistive members on the first heat generating resistive members with the exception of the heat generating portions of the heat generating resistive members; covering the electrode wiring pattern with second heat generating resistive members; and forming the protection film on the second heat generating resistive members.

In accordance with the present invention, the structure is formed so that the upper and lower heat generating members are arranged with the electrodes connected with the heat generating resistive members sandwiched between them. Thus, it is made possible to make the protection film on the upper layer thinner to attempt the power saving. Also, there is no need for making the effective bubbling area smaller, hence providing a highly reliable ink jet recording head operational in high density.

DETAILED DESCRIPTION OF THE INVENTION

As described above, in accordance with the present invention, the structure is formed to arrange each of the heat generating resistive members on both upper and lower faces of the electrodes connected with it. In this way, the film on the upper face can suppress the hillocks of the Al layer where the electrode wiring pattern is formed at the time of forming the protection film, thus making it possible to attain the provision of the thinner protection film. Also, the electrode wiring is connected with the surface of each heat generating resistive member arranged on the lower face of the wiring in order to secure the resistive values stably. Also, If the film thickness of the protection film on the heat generating portion is made more than 700 nm, the lowering effect of the power dissipation becomes almost invalid. Therefore, it is preferable to set the film thickness of the protection film at a range of 200 to 700 nm. For the formation of the protection film, it is possible to adopt the sputtering method, the CVD method, the plasma CVD method, the LP (lower-pressure) CVD method, or the like. It is particularly preferable to adopt the LPCDV method, which uses a film formation temperature of 700 to 800° C., which is higher than any other methods, because with this method the film quality becomes excellent when it is formed.

Also, in accordance with the present invention, the electrode wiring pattern is formed for the upper and lower heat generating members. Here, the structure is arranged so that the heat generating resistive member arranged on the lower face of the electrode wiring pattern is separated on the heat generating portion of the heat generating resistive member. In this manner, the heat generating resistive member on this side is arranged only on the circumferential portion of the electrode wiring pattern. Thus, it is attempted to make resistance higher for each of the heat generating resistive members.

Also, in accordance with the present invention, a structure is adopted to remove the portion of the heat generating resistive member arranged on the lower face of the electrode wiring pattern which corresponds to the central part of the heat generation of the heat generating portion of each heat generating resistive member, hence arranging only each of the heat generating circumferential portions accordingly. In this way, it becomes possible to enable electric current to flow largely on each circumferential portion of the heat generating resistive member where the effective temperature tends to be lowered. Now that the temperature of the circumferential portions is raised, each of the bubbling areas can be expanded, and it becomes possible to implement the arrangement of the higher pitches to provide more density advantageously.

Embodiments

Hereinafter, the embodiments will be described in accordance with the present invention.

First Embodiment

Figure 1:
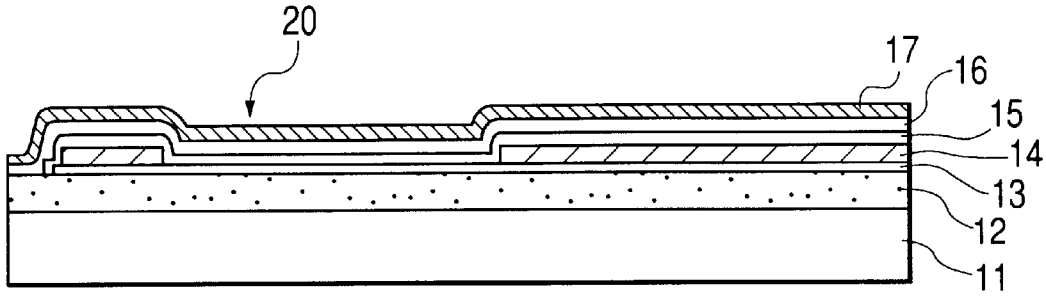
FIG. 1 is a cross-sectional view which shows the substrate in accordance with a first embodiment of the present invention, taken along one dot chain line I—I in a plan view in FIG. 2.
Figure 2:
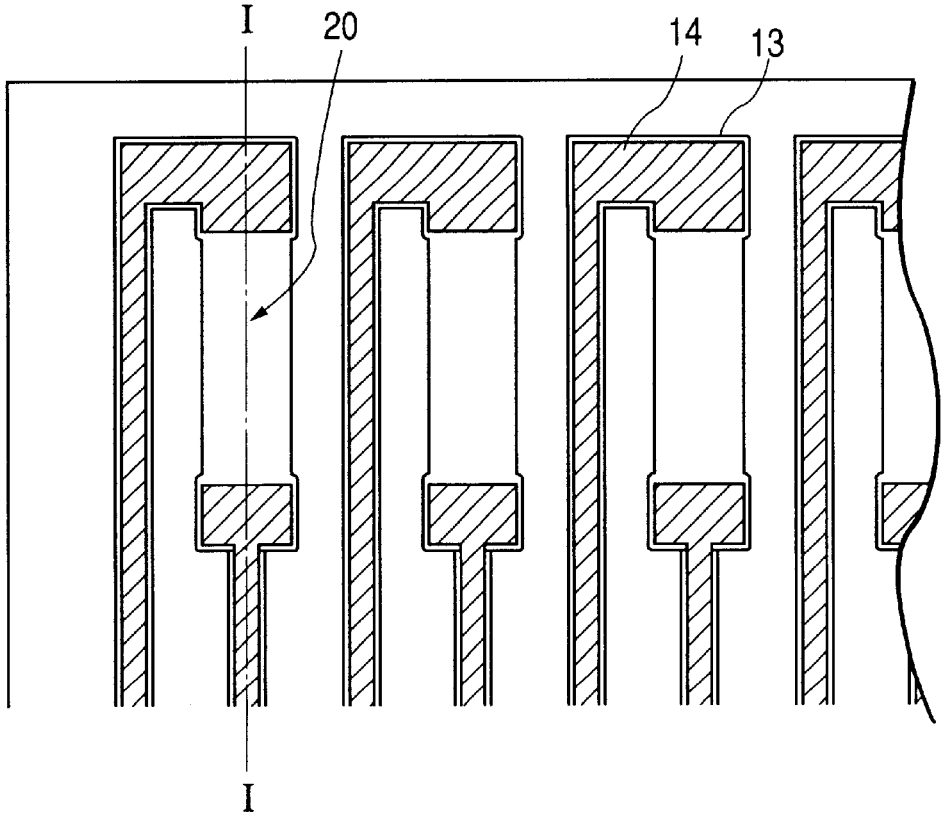
FIG. 2 is the plan view which shows the substrate in accordance with the first embodiment of the present invention.

FIG. 1 is a cross-sectional view which shows the characteristic aspect of the present invention in the best way, taken along one dot broken line I—I of the plan view of the heat generating resistive member represented in FIG. 2.

In FIG. 1, a reference numeral 11 designates an Si substrate; 12, an $SiO_2$ film serving as the heat accumulation layer; 13, a first layer of the heat generating resistive layer; 14, an Al layer serving as the wiring pattern; 15 a second layer of the heat generating resistive layer; 16, an SiN film serving as the protection film; and 17, the Ta serving as the cavitation proof film, which protects the protection film from being destroyed by cavitation.

Now, hereunder, the description will be made sequentially.

For the formation of the substrate used for the heat generating portion of the present embodiment, the Si substrate 11 is adopted. On this Si substrate, the $SiO_2$ film is formed by the thermal oxidation method, the CVD method, the sputtering method, or the like. This film becomes the heat accumulation layer 12 on the lower part of the heat generating resistive member.

Now, in conjunction with FIGS. 3A to 3E, the description will be made of the method of manufacture by following the procedural steps thereof.

Figure 3A:
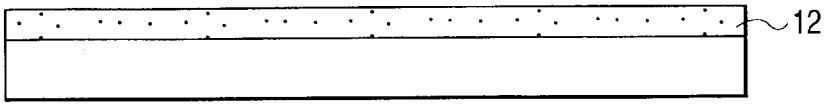
FIGS. 3A, 3B, 3C, 3D and 3E are views which illustrate the flow the manufacturing processes of the substrate in accordance with the first embodiment of the present invention.
Figure 3B:
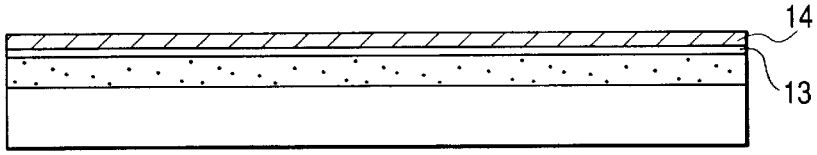

On the heat accumulation layer 12, a TaN layer 13 is formed by the reactive sputtering as the first layer of the heat generating resistive member in a thickness of approximately 50 nm, and the Al layer 14 is formed by sputtering as the electrode wiring in a thickness of 500 nm as shown in FIG. 3B. Then, by use of the photolithographic method, the wiring pattern is formed, and etching is performed by the Al wet etching method and the TaN reactive ion etching method, thus forming the pattern configured in the sectional structure as shown in FIG. 3C.

Figure 3C:
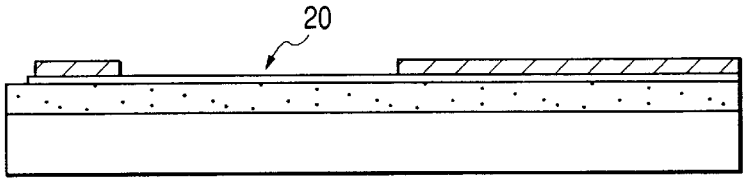
Figure 3D:
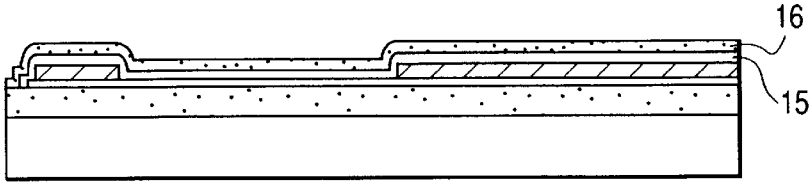
Figure 3E:
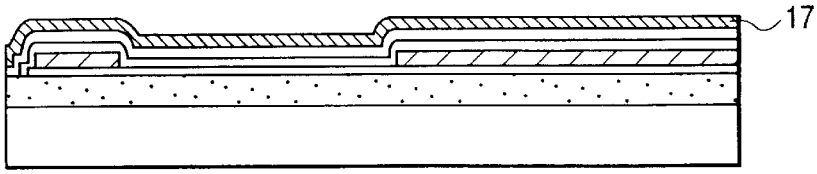

Here, as shown in FIG. 1, FIG. 2, and FIG. 3C, the portion where the Al is partly removed at 20 becomes the heat generating portion.

Now, the heat generating resistive member TaN is again formed by the reactive sputtering as the second film layer in a thickness of 50 nm. Then, by use of the photolithographic method, the patterning is performed to configure it in the same configuration of the first-layered heat generating resistive member. In this manner, The Al layer is sandwiched completely by both the upper and lower faces, and the hillocks and others are not allowed to be developed when heat is given.

Then, SiN is formed as the protection film by the CVD method at a film formation temperature of 450° C. in a thickness of 500 nm. Subsequently, Ta is form sputtering in a thickness of 200 nm. Lastly, by use of the photolithographic method, Ta film and the Sin protection film are patterned to enable the Al pads to be exposed for use of connection with the external power-supply source. Then, the assembling of an ink jet head is carried out with the ink jet head substrate thus formed to confirm the performance of the head. As a result, the power dissipation is usually reduced by 20% per 1 $\mu$m protection film. However, there is no difference in the life as compared with the head having the 1 $\mu$m protection film used at $1\times10^8$ pulses/nozzle.

Second Embodiment

Figure 4:
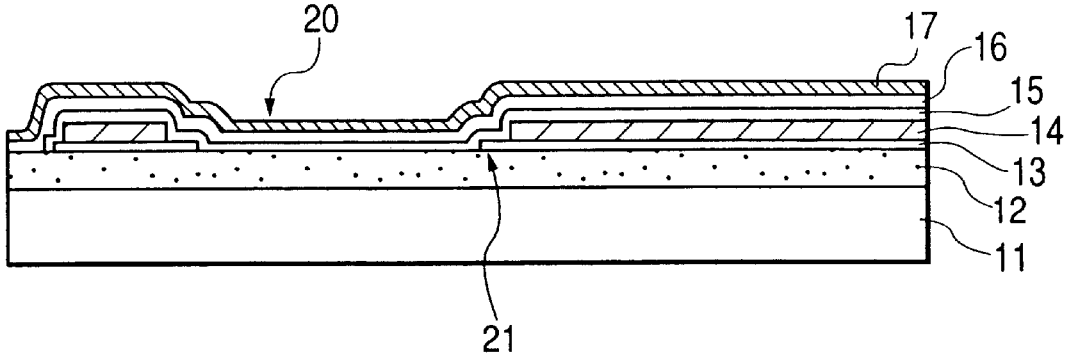
FIG. 4 is a cross-sectional view which shows the substrate in accordance with a second embodiment of the present invention, taken along one dot chain line IV to IV in a plan view in FIG. 5.
Figure 5:
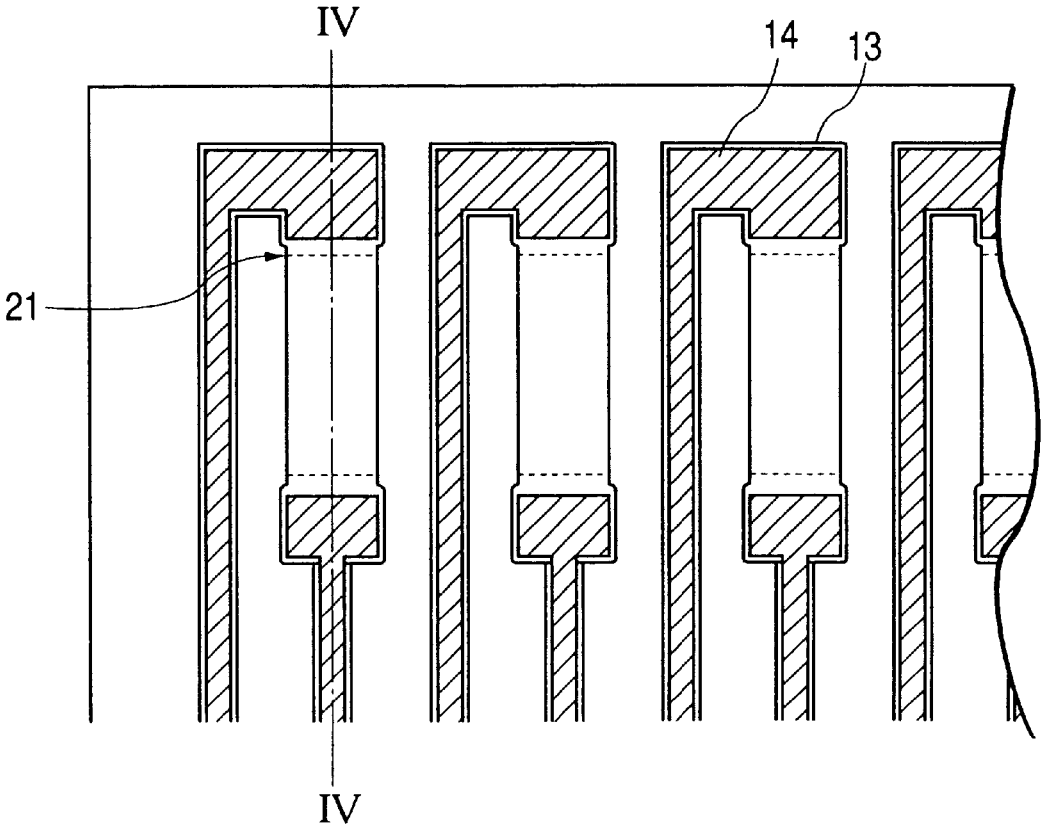
FIG. 5 is the plan view which shows the substrate in accordance with the second embodiment of the present invention.
Figure 6:
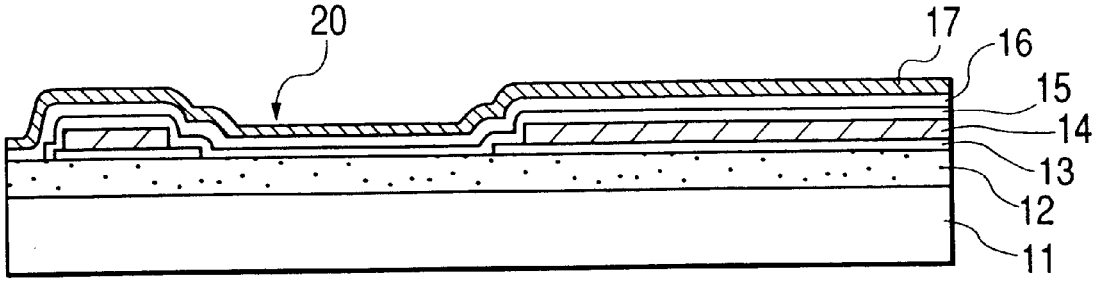
FIG. 6 is a cross-sectional view which shows the substrate in accordance with a third embodiment of the present invention taken along one dot chain line VI to VI in a plain view FIG. 7.

For the first embodiment, the structure is adopted so that the heat generating resistive layers are arranged with the electrodes sandwiched between them. However, since the two layers of the heat generating resistive layers are overlaid, the resistive value tens to be lowered if the structure is formed only in such a way as described. Therefore, in accordance with a second embodiment, a structure is adopted so that the lower heat generating resistive member is cut as a method for making the heat generating resistive member highly resistive. In other words, as indicated at 21 in FIG. 4 and FIG. 5, the lower layer pattern is only in the vicinity of the Al electrodes. Actually, the width of the heat generating resistive member which is projected from each electrode is 4 $\mu$m. As a result, the contact between the heat generating resistive members arranged on the upper and lower layers is made good enough to prevent the fluctuation of the resistive value, and the heat generating resistive members present higher resistance in this layered structure.

Third Embodiment

Figure 7:
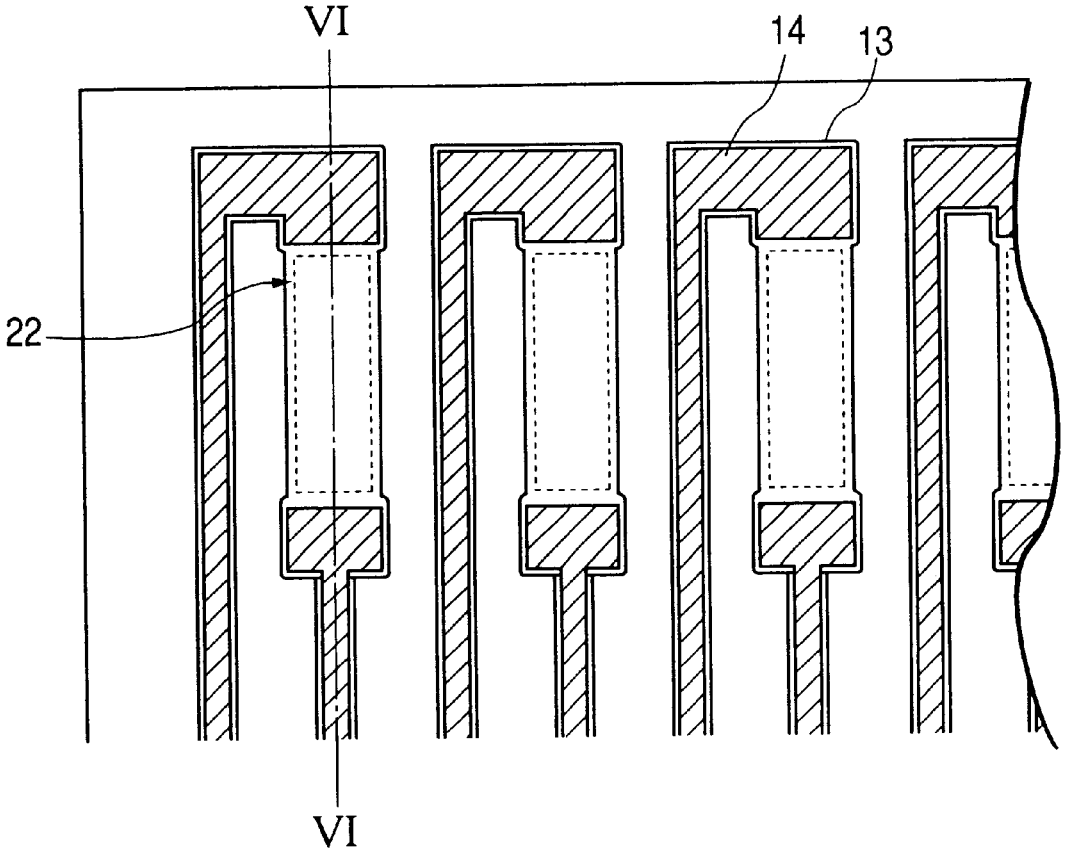
FIG. 7 is the plan view which shows the substrate in accordance with the third embodiment of the present invention.

For the second embodiment, the heat generating resistive member on the lower layer is arranged only in the Al electrodes. For a third embodiment, the structure is arranged so that, as indicated at 22 in FIG. 7, only the central portion of the lower-layered heat generating resistive member is removed, while the circumferential portion thereof remains in tact. More specifically, the portion of the lower-layered heat generating resistive member on the inner side of the pattern of the upper-layered heat generating resistive member by 4 $\mu$m is removed by the photolithographic process and the TaN dry-etching.

As a result, in the vicinity of each of the electrodes, the contact between the upper- and lower-layered heat generating resistive members is made good enough to eliminate the fluctuation of the resistive values.

Also, on the circumference of the heat generating resistive member, more heat is generated, hence making it possible to enlarge the size of bubble more by the rise of the circumferential temperature.

Other Embodiment

Hereunder, the description will be made of the ink jet recording head, and the ink jet recording apparatus to which the ink jet recording head of the present invention is applicable.

Figure 8:
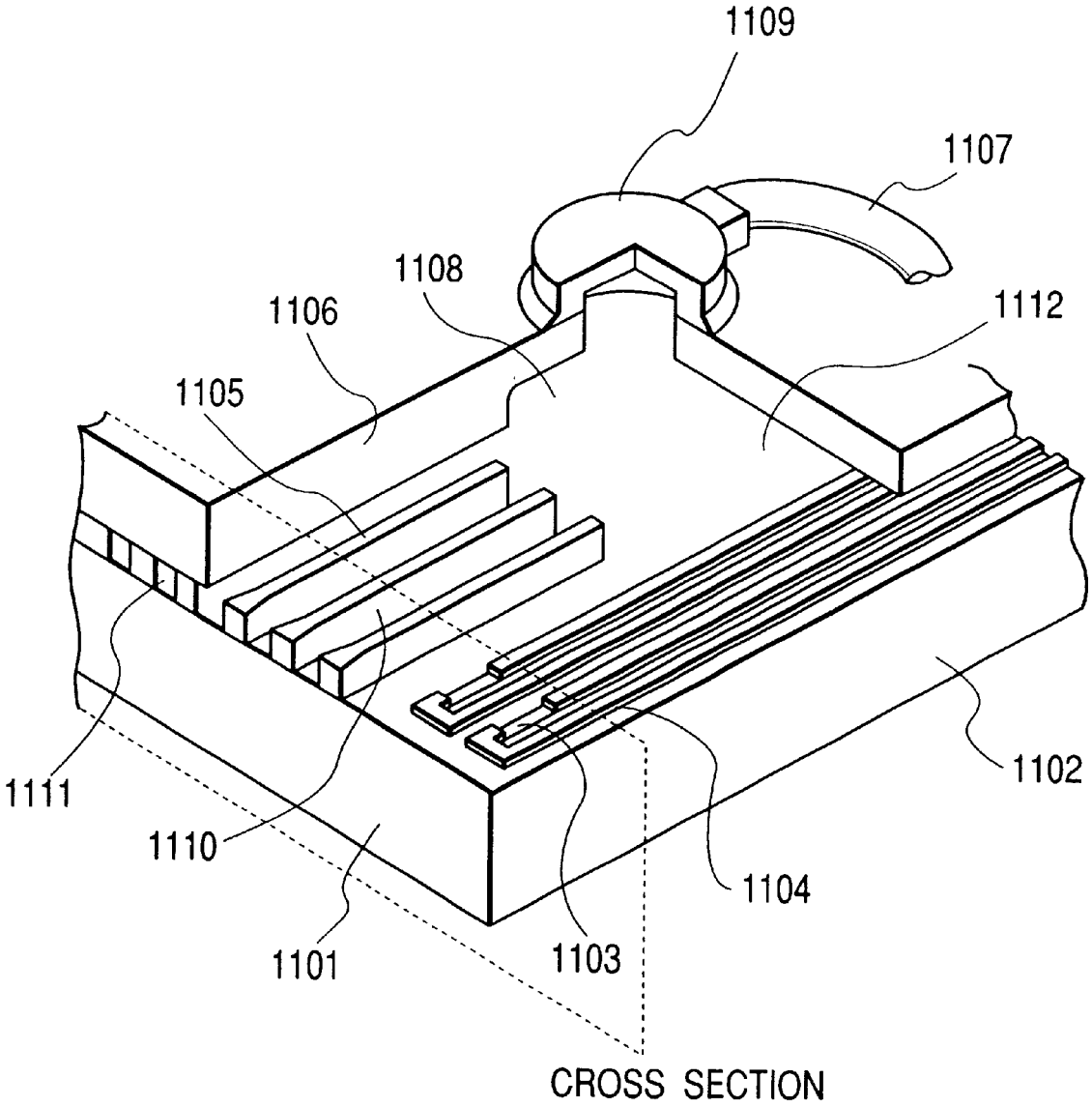
FIG. 8 is a view which schematically illustrates the ink jet head to which the substrate for an ink jet head of the present invention is applicable.

FIG. 8 is a view which schematically shows the structure of an ink jet recording head. The ink jet head is structured with each of the electrothermal transducing members 1103, the wiring 1104, the liquid flow path walls 1105, and the ceiling plate 1106, which are formed by means of film formation through the semiconductor processing steps, such as etching, vapor deposition sputtering.

The recording liquid 1112 is supplied from the liquid storage chamber (not shown) to the interior of the common liquid chamber 1108 of the head 1101 through the liquid supply tube 1107.

In FIG. 8, a reference numeral 1109 designates the connector for use of the liquid supply tube. The liquid 1112 supplied to the interior of the common liquid chamber 1108 is further supplied to the liquid flow paths 1110 by means of the so-called capillary phenomenon. Then, with the meniscus formed on the discharge port surface on the leading end of each liquid flow path (orifice surface), the supplied liquid is held stably.

Here, when each of the electrothermal transducing members 1103 is energized, the liquid on the surface of the electrothermal transducing member is abruptly heated to create bubble in the liquid. With the expansion and shrinkage of such bubble, the liquid is discharged from the discharge port 1111 communicated with the liquid flow path, hence forming each of the liquid droplets.

Figure 9:
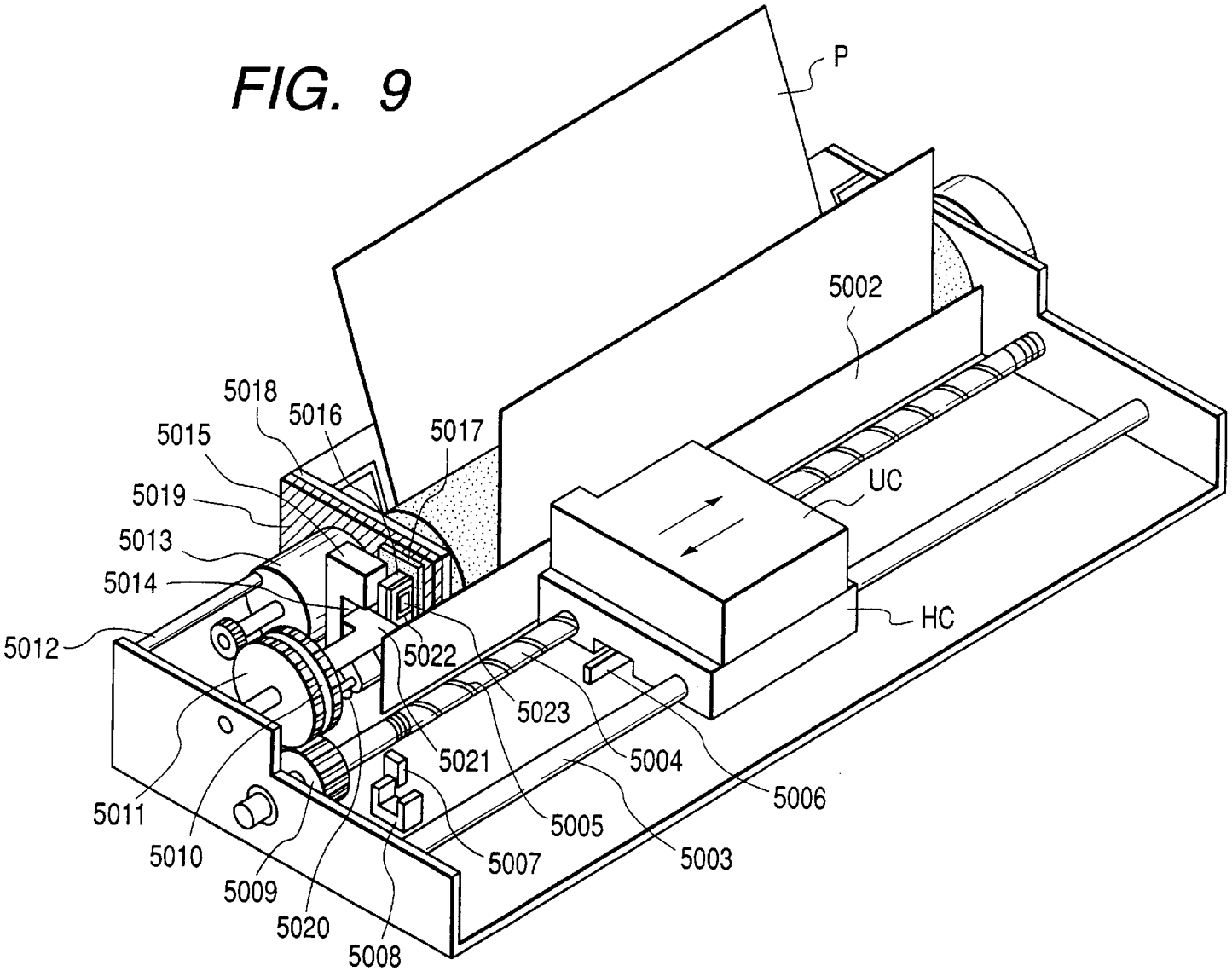
FIG. 9 is a view which schematically illustrates the ink jet recording apparatus using the ink jet recording head to which the substrate for an ink jet head of the present invention is applicable.

FIG. 9 is a view which shows the external appearance of the ink jet recording apparatus to which the present invention is applicable. The carriage HC is provided with a pin (not shown) which engages with the spiral groove 5005 of the lead screw 5004 rotative through the driving power transmission gears 5011 and 5009 interlocked with the regular and reverse rotations of the driving motor 5013, hence reciprocating in the directions indicted by arrows. A reference numeral 5002 designates the paper pressure plate to press a paper sheet to the platen 5000 in the traveling direction of the carriage. Reference numerals 5007 and 5008 designate the photocoupler which serves as home position detecting means to recognize the carriage lever 5006 in the zone covered by them to switch the rotational directions of the motor 5013 among some other operations. A reference numeral 5016 designates the member that supports the capping member 5022 to cap the front end of the recording head; 5015, suction means that sucks the interior of the cap to operate the suction recovery of the recording head through the aperture 5023 in the cap; 5017, the cleaning blade; 5019, the member that makes the blade movable forward and backward, which is supported by the supporting plate 5018 of the main body of the apparatus. The blade is not necessarily limited to this mode. It is of course possible to adopt any one of the known blades for the present embodiment. Also, a reference numeral 5012 designates the lever for initiating the suction recovery, which moves along the movement of the cam 5020 that engages with the carriage. The movement is controlled by the control of the driving power of the driving motor by known transmission means such as to change clutches or the like.

These capping, cleaning, and suction recovery are structured to be able to execute the desired operation by the function of the lead screw 5004 when the carriage arrives in the region on the home position side. However, any one of them is applicable to the present invention if only the desired operation is made executable at the known timing. Each of the structures described above is an excellent invention itself whether it is individually applied or complexly applied in combination, which also presents the preferable example with respect to the present invention. Here, this apparatus is provided with means for supplying driving signals to drive each of the ink discharge pressure generating members.

What is claimed is:

1. An ink jet recording head substrate provided with a plurality of heat generating resistive members and the electrode wiring pattern electrically connected with said heat generating resistive members formed on the substrate, and a protection film formed on said heat generating resistive members and said electrode wiring pattern to protect them from ink, wherein each of said heat generating resistive members comprises a first heat generating resistive member arranged on the lower layer of said electrode wiring pattern connected with said heat generating resistive member, and a second heat generating resistive member arranged between said protection film and said electrode wiring pattern, wherein the portion of said first heat generating resistive member corresponding to the central part of heat generation of the heat generating portion of the heat generating resistive member is removed, and only the heat generating circumferential portion is arranged.

2. An ink jet recording head substrate provided with a plurality of heat generating resistive members and the electrode wiring pattern electrically connected with said heat generating resistive members formed on the substrate, and a protection film formed on said heat generating resistive members and said electrode wiring pattern to protect them from ink, wherein each of said heat generating resistive members comprises a first heat generating resistive member arranged on the lower layer of said electrode wiring pattern connected with said heat generating resistive member, and a second heat generating resistive member arranged between said protection film and said electrode wiring pattern, wherein said first heat generating resistive member is separated on the heat generating portion of the heat generating resistive member, and arranged only on the circumferential portion of said electrode wiring pattern.

3. An ink jet recording head substrate according to claim 1 or claim 2, wherein said electrode wiring pattern is formed with Al.

4. An ink jet recording head substrate according to claim 1 or claim 2, wherein the thickness of said protection film is 200 to 700 nm.

5. An ink jet recording head provided with an ink jet recording head substrate having a plurality of heat generating resistive members and the electrode wiring pattern electrically connected with said heat generating resistive members formed on the substrate, and a protection film formed on said heat generating resistive members and said electrode wiring pattern to protect them from ink; discharge ports for discharging ink; and liquid paths communicated with said discharge ports, wherein each of said heat generating resistive members comprises a first heat generating resistive member arranged on the lower layer of said electrode wiring pattern connected with said heat generating resistive member, and a second heat generating resistive member arranged between said protection film and said electrode wiring pattern, wherein the portion of said first heat generating resistive member corresponding to the central part of heat generation of the heat generating portion of the heat generating resistive member is removed, and only the heat generating circumferential portion is arranged.

6. An ink jet recording head provided with an ink jet recording head substrate having a plurality of heat generating resistive members and the electrode wiring pattern electrically connected with said heat generating resistive members formed on the substrate, and a protection film formed on said heat generating resistive members and said electrode wiring pattern to protect them from ink; discharge ports for discharging ink; and liquid paths communicated with said discharge ports, wherein each of said heat generating resistive members comprises a first heat generating resistive member arranged on the lower layer of said electrode wiring pattern connected with said heat generating resistive member, and a second heat generating resistive member arranged between said protection film and said electrode wiring pattern, wherein said first heat generating resistive member is separated on the heat generating portion of the heat generating resistive member, and arranged only on the circumferential portion of said electrode wiring pattern.

7. An ink jet recording head according to claim 5 or claim 6, wherein said electrode wiring pattern is formed with Al.

8. An ink jet recording head according to claim 5 or claim 6, wherein the thickness of said protection film is 200 to 700 nm.

9. A method for manufacturing an ink jet recording head provided with an ink jet recording head substrate having a plurality of heat generating resistive members and the electrode wiring pattern electrically connected with said heat generating resistive members formed on the substrate, and a protection film formed on said heat generating resistive members and said electrode wiring pattern to protect them from ink; the discharge ports for discharging ink; and the liquid paths communicated with said discharge ports, comprising the following steps of:

forming first heat generating resistive members on said substrate;

forming said electrode wiring pattern connected with said first heat generating resistive members on said first heat generating resistive members with the exception of the heat generating portions of the heat generating resistive members;

covering said electrode wiring pattern with second heat generating resistive members; and forming said protection film on said second heat generating resistive members, wherein each portion of said first heat generating resistive members corresponding to the central part of heat generation of the heat generating portion of the heat generating resistive member is removed, and only the heat generating circumferential portion is arranged.

10. A method for manufacturing an ink jet recording head provided with an ink jet recording head substrate having a plurality of heat generating resistive members and the electrode wiring pattern electrically connected with said heat generating resistive members formed on the substrate, and a protection film formed on said heat generating resistive members and said electrode wiring pattern to protect them from ink; the discharge ports for discharging ink; and the liquid paths communicated with said discharge ports, comprising the following steps of:

forming first heat generating resistive members on said substrate;

forming said electrode wiring pattern connected with said first heat generating resistive members on said first heat generating resistive members with the exception of the heat generating portions of the heat generating resistive members;

covering said electrode wiring pattern with second heat generating resistive members; and forming said protection film on said second heat generating resistive members, wherein each of said first heat generating resistive members is separated on the heat generating portion of the heat generating resistive member, and arranged only on the circumferential portion of said electrode wiring pattern.

11. A method for manufacturing an ink jet recording head according to claim 9 or claim 10, wherein the film formation temperature is 400° C. or more in the film formation step for said protection film.

12. A method for manufacturing an ink jet recording head according to claim 9 or claim 10, wherein the film formation of said protection film is executed by means of LPCVD.

13. A method for manufacturing an ink jet recording head according to claim 9 or claim 10, wherein said electrode wiring pattern is formed with Al.

14. A method for manufacturing an ink jet recording head according to claim 9 or claim 10, wherein the thickness of said protection film is 200 to 700 nm.

* * * * *